United States Patent [19]

Torruella

[11] 4,396,238

[45] Aug. 2, 1983

[54] TOOTHBRUSH HOLDER

[75] Inventor: Jorge V. Torruella, Barcelona, Spain

[73] Assignee: Pervisa S.A., Barcelona, Spain

[21] Appl. No.: 232,336

[22] Filed: Feb. 6, 1981

[30] Foreign Application Priority Data

Feb. 7, 1980 [ES] Spain ..... 248403[U]
Jun. 17, 1980 [ES] Spain ..... 251466[U]

[51] Int. Cl.[3] ..... A46B 17/02

[52] U.S. Cl. ..... 312/206; 312/207; 248/111; 211/65

[58] Field of Search ..... 312/206, 207; 248/108, 248/109, 110, 111, 113; 211/65, 66

[56] References Cited

U.S. PATENT DOCUMENTS

| | | | |
|---|---|---|---|
| 872,091 | 11/1907 | Spangler | 312/207 |
| 1,170,065 | 2/1916 | Hirschman | 312/206 |
| 2,507,342 | 5/1950 | Licari et al. | 312/207 |
| 2,600,345 | 6/1952 | Venditti | 312/207 |
| 2,720,439 | 10/1955 | San Cristoval | 312/206 |
| 2,757,787 | 8/1956 | Sergent | 312/207 |
| 2,950,946 | 8/1960 | Starworth | 312/207 |
| 3,085,678 | 4/1963 | Moore | 312/207 |
| 3,124,399 | 3/1964 | Seta | 312/206 |
| 3,138,414 | 6/1964 | La Pollo | 312/207 |
| 3,977,743 | 8/1976 | Harris | 312/207 |

FOREIGN PATENT DOCUMENTS

| | | | |
|---|---|---|---|
| 1162959 | 9/1958 | France | 312/207 |

*Primary Examiner*—Victor N. Sakran
*Attorney, Agent, or Firm*—Blum, Kaplan, Friedman, Silberman & Beran

[57] ABSTRACT

A toothbrush holder comprises a box fastened to a vertical surface and lid hingedly attached to the box. The lid includes a leaf which is deflected upon insertion in the box of a toothbrush and causes the lid to automatically close over the brush head.

8 Claims, 6 Drawing Figures

FIG. 1
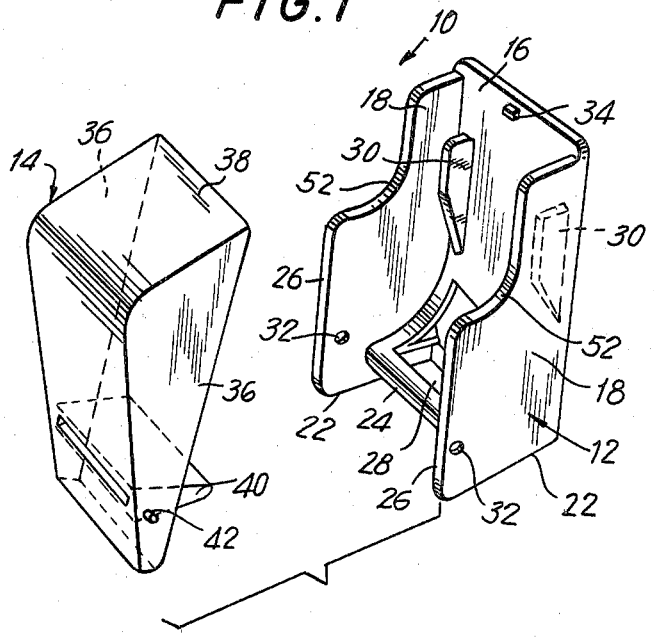
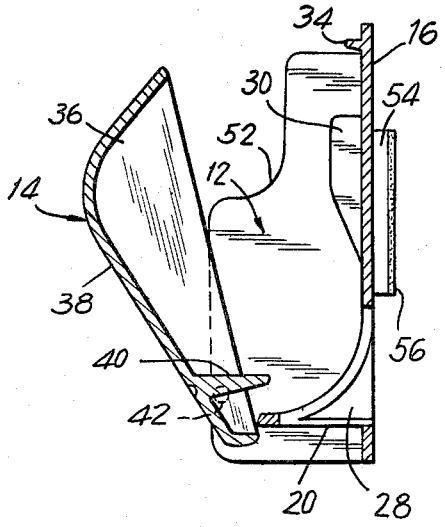
FIG. 2
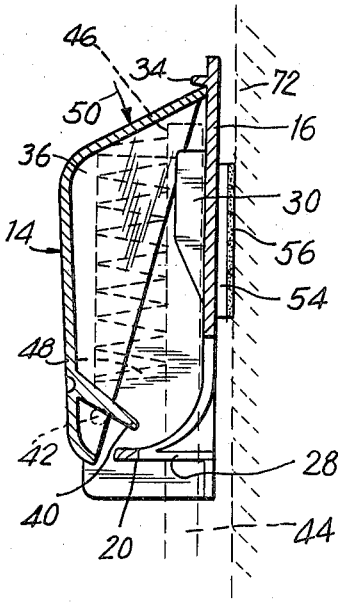
FIG. 3

FIG. 4
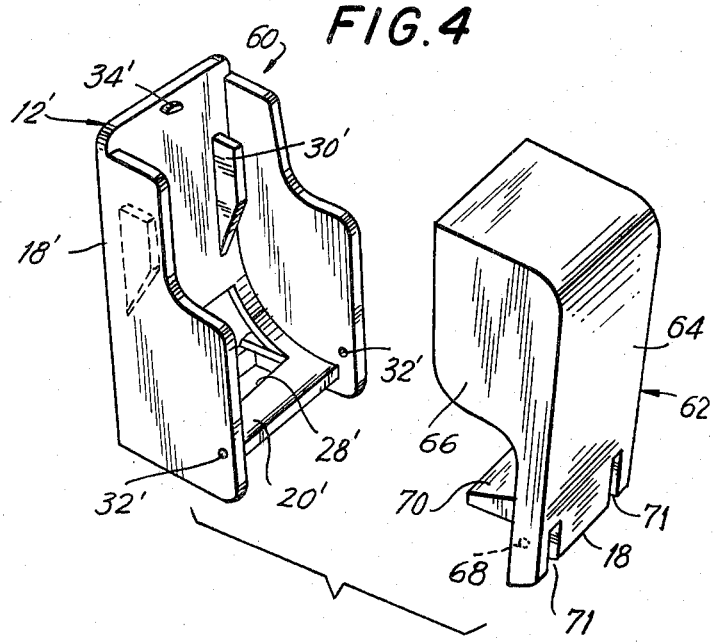
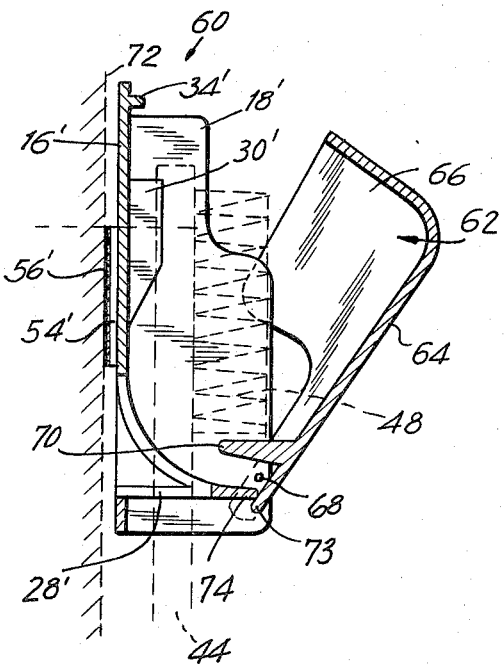
FIG. 5
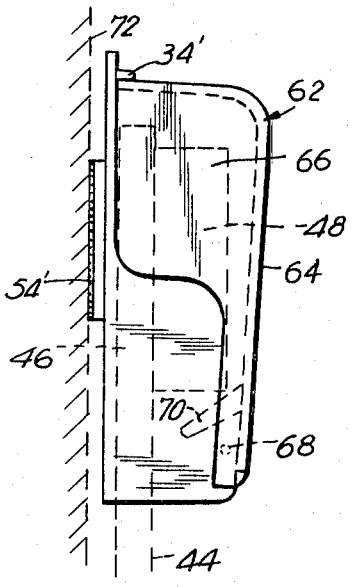
FIG. 6

TOOTHBRUSH HOLDER

BACKGROUND OF THE INVENTION

This invention relates generally to a toothbrush holder of the type which is wall mounted and protects the bristles from exposure to dust and dirt, and more particularly to a toothbrush holder which automatically closes over a brush which is inserted. Toothbrush holders of the prior art consist of an open-topped box which is affixed by a rear surface to a wall or other vertical surface. The box is provided with an opening in the bottom through which the handle of the toothbrush passes from above. The brush head with bristles rests on the inner surface of the bottom panel of the box. A lid including two intersecting planes is hinged to the front part of the box and pivots to close the box with the head and bristles of the brush contained within and protected against dust and dirt. This toothbrush holder of the prior art is practical because it is possible to properly support the brush in an accessible manner with adequate protection for the bristles. However, there is a disadvantage that the lid of the box must be moved by hand in order to close the box after the brush has been inserted. This is a bother for the user.

What is needed is a toothbrush holder which provides a cover over the brush head and bristles and yet requires no special operation by the user to close the cover.

SUMMARY OF THE INVENTION

Generally speaking, in accordance with the invention, a toothbrush holder especially suitable for containing and protecting the head and bristles of a toothbrush is provided. The toothbrush holder comprises a box fastened to a vertical surface and a lid hingedly attached to the box. The lid includes a leaf which is deflected upon insertion in the box of a toothbrush and causes the lid to automatically close over the brush head. Side flanges within the box constrain the position of the brush head and prevent damage to the bristles. A catch tab holds the cover in place until the brush is needed. In one embodiment the lid is partially within the box and in another alternative embodiment the lid is outside the box.

Accordingly, it is an object of this invention to provide an improved toothbrush holder having means to automatically cover the head and bristle of an inserted brush.

Another object of this invention is to provide an improved toothbrush holder which provides means for securely holding the lid in a closed position.

A further object of this invention is to provide an improved toothbrush holder which maintains the lid in a favorable position for operation when the box is empty.

Still another object of this invention is to provide an improved toothbrush holder which has few movable parts, is simple to operate, and economical to produce.

Yet another object of this invention is to provide an improved toothbrush holder which protects the brush bristles from damage.

Still other objects and advantages of the invention will in part by obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a top exploded perspective view of a toothbrush holder in accordance with this invention;

FIG. 2 is a side elevational view in section of an assembled toothbrush holder of FIG. 1 in an open condition;

FIG. 3 is a view similar to FIG. 2 showing a closed condition;

FIG. 4 is a view similar to FIG. 1 of an alternative embodiment of a toothbrush holder in accordance with this invention; and FIGS. 5 and 6 are views similar to FIGS. 2 and 3 respectively of the toothbrush holder in accordance with FIG. 4, wherein FIG. 6 is a side elevation view.

DESCRIPTION OF THE PREFERRED EMBODIMENTS

With reference to FIGS. 1–3, the toothbrush holder 10 in accordance with this invention is comprised of a box 12 and a lid 14. The box 12 includes a planar back surface 16 and a pair of side panels 18 connected perpendicularly to the back 16. A bottom element 20 connects to the back surface 16 and side panels 18 and is elevated above the lowest edges 22 of the side panels 18. The bottom element 20 has a leading edge 24 which is set back from the leading edges 26 of the side panels 18. A rectangular opening 28 in the bottom element 20 allows for passage therethrough of the handle of a toothbrush as described more fully hereinafter. A pair of flanges 30 extend from the back surface 16 to provide guidance and lateral constraint for a toothbrush, and a pair of holes 32 pass through the side panels 18 proximate to the bottom element 20 and the leading edges 26 on the side panels. Further, a tab 34 is located at the center, near the top, of the back surface 16.

The lid 14 includes two side panels 36, generally triangular in shape, joined transversely to a generally L-shaped front surface 38. A leaf 40 extends between the side panels 36 from the inside of the front surface 38. A pin 42 extends from each side panel 36 of the lid 14.

When assembled, the pins 42 are inserted into the holes 32 of the box 12 such that a hinge is formed and pivoting of the lid 14 on the pins 42 is made possible.

When the lid 14 is in the open position as shown in FIG. 2, the handle 44 of a toothbrush is passed through the rectangular opening 28 in the bottom element 20 with the bristles on the brush head 46 extending away from the back surface 16. As the toothbrush is lowered into the box 12, the lower edge of the bristles strikes against the leaf 40 on the lid 14 causing the lid 14 to pivot on the pins 42 such that the lid 14 swings into the position shown in FIG. 3 with the upper edge of the lid 14 proximate the back surface 16 of the box 12. The head 46 fits between the pair of flanges 30 so that the brush remains substantially vertically aligned.

Slight pressure applied to the lid 14 as indicated by the arrow 50 causes the upper edge of the lid 14 to be wedged beneath the tab 34 on the back panel 16 of the box 12, whereby the lid is held securely in place. The lid 14 is fabricated of a material having flexibility which allows it to be pressed beneath the tab 34. For example, the lid 14 can be fabricated of transparent or translucent plastic.

As seen in the figures, the side panels 18 of the box 12 have offsets 52, of reduced width, from the back surface 16 to the leading edges 26 of the side panels 18. When the box is closed, as shown in FIG. 3, portions of the side panels 36 of the lid 14 are exposed by the offsets 52 such that the box may be readily opened for removal of the toothbrush by gripping the lid 14 in the region of the offsets 52.

A pad 54 having an adhesive 56 on the outer surface thereof, is attached to the external surface of the back panels 16 of the box 12. Prior to installation, the adhesive coating 56 is covered by a paper sheet which is peeled off to expose the sticking surface. The toothbrush holder 10 in accordance with this invention can be attached to any surface, preferably a vertical surface, by pressing the exposed adhesive 56 against the mounting surface.

FIGS. 4–6 show an alternative embodiment of a toothbrush holder in accordance with this invention. The toothbrush holder 60 includes a box 12' and a lid 62. The box 12' is substantially similar to the box 12 of FIG. 1 and similar reference numerals, distinguished by a prime marking (′), identify similar elements of the box 12'.

The lid 62 includes an L-shaped front surface 64 connected to side panels 66. A pair of pins 68 extend inwardly from the side panels 66 near the lower end of the lid 62. A leaf 70 extends inwardly from the L-shaped front surface 64 for engagement with the toothbrush bristles as explained more fully hereinafter.

As shown in FIGS. 5 and 6, when assembled, the toothbrush holder 60 in accordance with this invention joins the box 12' to the lid 62 by engagement of the pins 68 in the holes 32' of the box 12'. In this embodiment, the side panels 18' of the box 12' are within the side panels 66 of the lid 62. Rectangular notches 71 at the lower edge of the front surface 64 permit the lid 62 to pivot on the pins 68.

In the open position (FIG. 5) the lower edge 73 of the lid 62 abutts the outer most extremity 74 of the bottom element 20 at a position proximate to the pins 68. Accordingly, the lid 62 is prevented from falling under gravity below the position shown in FIG. 5 whereby the leaf 70 is in position to be contacted by the bristles 48 of the brush head 46 when the toothbrush handle 44 is inserted from above through the rectangular opening 28' in the box 12'.

The toothbrush holder 60 is held to the wall by a pad 54' affixed to the back surface 16' of the box 12' and having an adhesive coating 56'. The adhesive 56' attaches to a wall or a vertical surface 72.

When the toothbrush handle is inserted through the rectangular opening 28' in the box 12', and lowered, the bristles 48 of the brush head 46 contact the leaf 70 and pivot the lid 62 from the open position (FIG. 5) to the closed position (FIG. 6). Thereby, the toothbrush holder 60 in accordance with this invention is closed so as to shield the bristles without the need of direct intervention by the user. The lid 62 is made of a semi-rigid material as described above, and with slight finger pressure is pressed beneath the tab 34' where it is securely held until the user opens the holder with his hands.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A toothbrush holder for shielding the bristle head of a toothbrush, said toothbrush including said head and an extended handle, comprising:

a box, said box having at least a back member, side panels extended from opposite sides of said back member, the top and front of said box being open, the bottom of said box including a restricted opening whereby said handle may be passed through said box between said top and said bottom;

a lid, one of said lid and said side panels having pins extending therefrom and engaging in holes in the other one of said lid and side panels whereby said lid is pivotably mounted to said side panels, said lid in a first pivoted position exposing said open box top for passage therethrough of said handle, said lid in a second pivoted position being adapted to cover said open front and open top of said box, said lid having a leaf extending between said side panels, said leaf obstructing the passage of said brush head through said box, the force of said head against said leaf causing said lid to pivot on said pins whereby the front and top of said box are covered, said brush being supported on said leaf.

2. The toothbrush holder as claimed in claim 1, and further comprising means for reversibly securing said lid to said back element, said lid being in said second pivoted position.

3. The toothbrush holder as claimed in claim 2, wherein said means for securing is a tab extending from said back member, said lid and said tab being adapted for frictional sliding engagement to secure said lid.

4. The toothbrush holder as claimed in claim 3 or 1, and further including guide means for aligning and centering said brush head within said box, said alignment being in the direction of motion of said brush from said top to said bottom.

5. A toothbrush holder as claimed in claim 4, wherein said guide means include parallel flanges connected to said back member.

6. A toothbrush holder as claimed in claim 1, wherein said box and said side panels are integral.

7. A toothbrush holder as claimed in claim 1, wherein said pins are connected to said lid, said pins engaging holes in said side elements, whereby said lid is pivotably mounted.

8. A toothbrush holder as claimed on claim 1, and further comprising means for attachment of said toothbrush holder to a surface, said means for attachment being connected to said box.

* * * * *